United States Patent [19]

Kahlert et al.

[11] 4,427,193

[45] Jan. 24, 1984

[54] SHEET GRIPPING ARRANGEMENT

[75] Inventors: Peter Kahlert; Helmut Schöne; Hans Johne, all of Radebeul; Arndt Jentzsch; Victor Hefftler, both of Coswig; Werner Kühnert, Radebeul; Rainer Karl, Coswig; Norbert Dittmann; Heiner Fink, both of Dresden; Karl-Heinz Preussger, Meissen, all of German Democratic Rep.

[73] Assignee: Veb Kombinat Polygraph "Werner Lamberz" Leipzig, Leipzig, German Democratic Rep.

[21] Appl. No.: 199,044

[22] Filed: Oct. 20, 1980

[30] Foreign Application Priority Data

Oct. 25, 1979 [DD] German Democratic Rep. ... 216448

[51] Int. Cl.[3] ..... B65H 29/06

[52] U.S. Cl. ..... 271/277; 101/408; 271/82

[58] Field of Search ..... 271/277, 268, 204, 205, 271/206, 82, 85; 101/408–412; 269/265, 274, 275

[56] References Cited

U.S. PATENT DOCUMENTS

| | | | |
|---|---|---|---|
| 1,271,329 | 7/1918 | Kyle | 101/412 |
| 3,671,706 | 6/1972 | Littrell | 101/412 X |
| 4,203,363 | 5/1980 | Walter | 271/277 X |

*Primary Examiner*—Richard A. Schacher

*Attorney, Agent, or Firm*—Michael J. Striker

[57] ABSTRACT

A sheet-gripping device for sheet-processing machines includes a sheet-gripping member with a sheet-supporting surface of non-elastic material and a counter sheet-gripping member with a counter sheet-supporting surface made of elastic material. The sheet-supporting surface of the sheet-gripping member is formed with a plurality of projections located in first and second rows which extend skew to one another whereby a high uniform effect is attained in holding and transferring sheets being processed in the grippers closed in a vertical direction.

11 Claims, 3 Drawing Figures

SHEET GRIPPING ARRANGEMENT

BACKGROUND OF THE INVENTION

The present invention relates to sheet gripping arrangements utilized in sheet-processing machines, for example printing machines.

The gripping arrangements generally known in the art include a sheet-gripping member and a counter gripping member which contact a sheet being processed and hold the latter, for example when this sheet is transferred from one processing station to the next processing station. The sheet-supporting surfaces of the sheet gripping members are made of elastic material and provided with substantially smooth outer surfaces contacting a sheet of paper. The counter sheet-supporting members have sheet-contacting surfaces normally made of non-elastic material with relatively roughened outer surfaces. Such structure of a gripping arrangement is disclosed in the U.S. Pat. No. 1,300,610.

The disadvantage of the known construction resides in that the sharp-edged roughened outer surfaces may lead to possibly even to tearing of the sheets and to a sufficient displacement thereof in the gripper so that they will be when they enter a subsequent processing station.

SUMMARY OF THE INVENTION

It is therefore an object of the invention to provide an improved sheet-gripping arrangement which overcomes by simple means the aforementioned drawbacks of the prior-art gripping devices.

Another object of the invention is to provide a sheet-gripping arrangement for sheet-processing machines with substantially increased gripping effect.

Still another object of the invention is to provide an improved gripping arrangement which prevents sheets being processed from damage during the gripping and sheet-transferring operation.

Yet another object of the invention is to prevent slippage which may occur between a sheet-gripping member and a counter sheet gripping member.

These and other objects of the invention are attained by a sheet gripping arrangement for sheet-processing machines, comprising a sheet-gripping member having an outer sheet-supporting surface contacting a sheet being processed and a counter sheet-gripping member having a counter sheet-supporting surface, said outer sheet-supporting surface including a plurality of projections positioned in first and second rows which extend skew to one another so as to form an oblique raster.

The outer sheet-supporting surface may be made of non-elastic material and said counter sheet-supporting surface may be made of elastic material.

The projections in said raster may be spaced from one another in a direction of sheet travelling a first predetermined distance and in a direction transversal to the sheet travelling a second predetermined distance, and first predetermined distance being substantially smaller than said second predetermined distance.

Less than 100 projections may be positioned per 1 square centimeter on said sheet-supporting surface. The combined contact surface area of said projections may form less than 10% of the total area of the sheet-supporting surface.

The size of each of said projections at the outer end thereof may be 0,3 mm.

The projections may have surface edges which are rounded.

Each projection may have the shape of a slim truncated cone. The angle of this cone may be at most 45°.

The projection may be formed as a truncated pyramid. The angle of inclination of this pyramid may also be at most 45°.

The elastic material of the counter sheet-supporting surface may have a hardness substantially equal to 90° on the Shore scale.

The sheet-gripping member of the gripping arrangement may be closed in a vertical direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
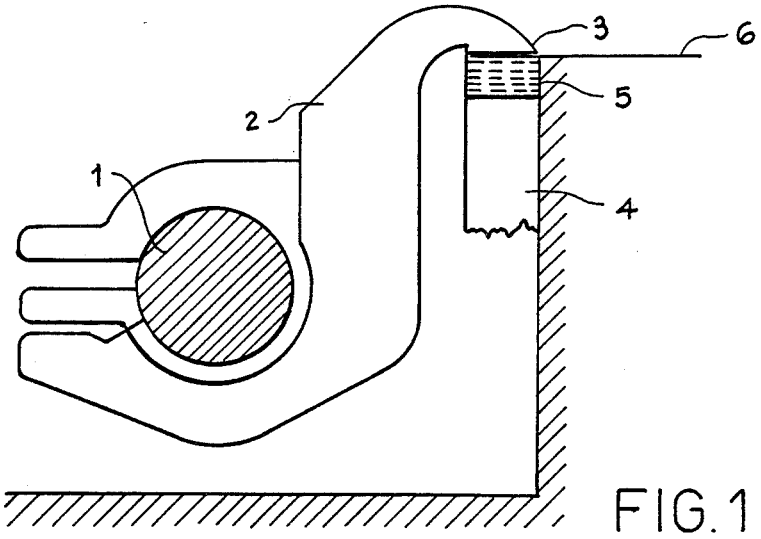
FIG. 1 is a an elevational view of a sheet-gripping arrangement according to the invention.

Referring to the drawings and first to FIG. 1, a sheet-gripping arrangement for gripping and further transferring a sheet being processed includes a shaft 1 on which a sheet-gripping member 2 is rigidly mounted. The sheet-gripping member is provided with a sheet-supporting surface 3 formed of non-elastic material which surface is in contact with a sheet to be printed designated at 6. Opposite to the member 2 a counter sheet-gripping member 4 is positioned which is formed with a counter sheet-gripping surface 5. The surface 5 is made of elastic material having a hardness substantially equal to 90° on the Shore scale. The paper sheet 6 or any other sheet being processed is positioned between the sheet-gripping member 2 which has a portion movable in a vertical direction and the counter sheet-gripping member 4.

Figure 2:
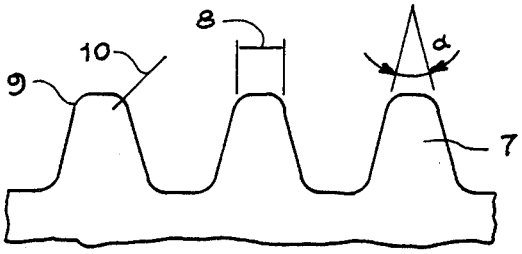
FIG. 2 is an enlarged partial side view illustrating a sheet-supporting surface of a sheet-gripping member in accordance with the invention.

Referring now to FIG. 2, the sheet-supporting surface 3 is formed with a plurality of identical projections 7 which have a frustoconical shape with the outer small diameter denoted at 8 which may be equal to 0,3 mm. The angle of the cone of each projection denoted as $\alpha$ is less than 45°. The projections 7 are bounded by edge surfaces which have rounded portions 9 with a radius 10.

Figure 3:
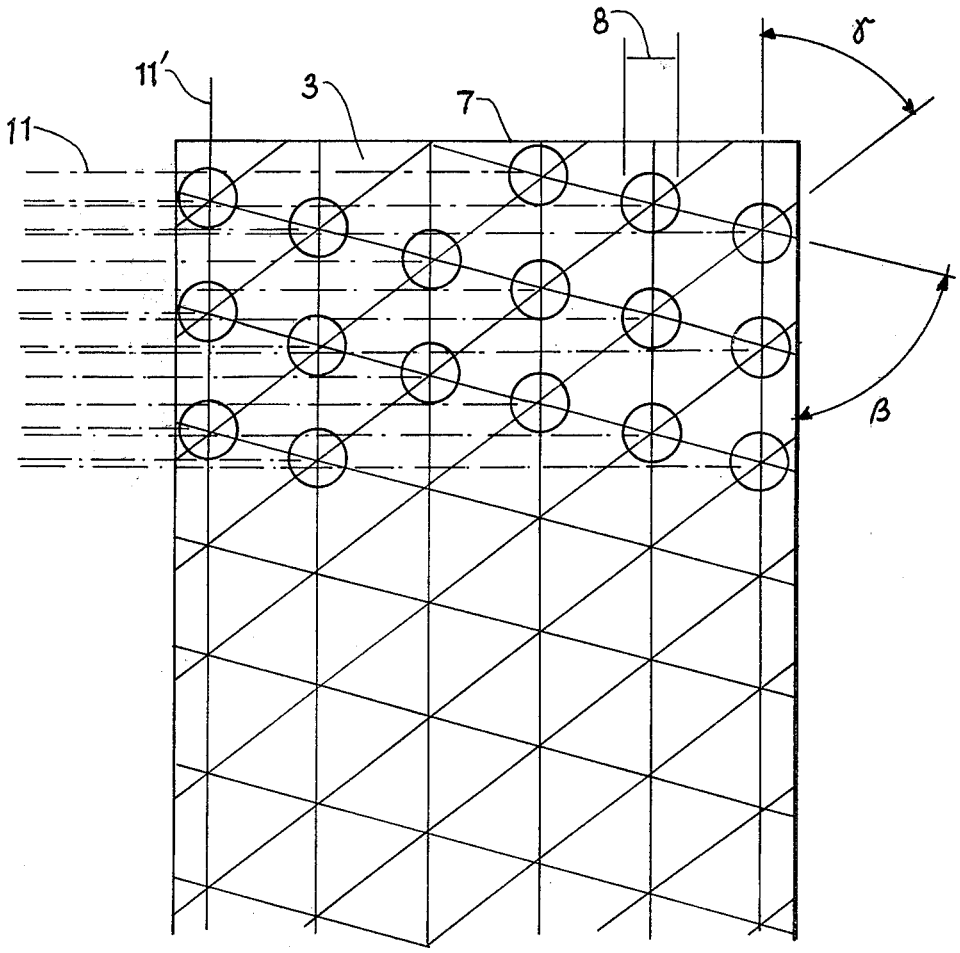
FIG. 3 is a top plan view of the sheet-supporting surface, in portion.

FIG. 3 illustrates a top plan view of the sheet-supporting surface 3 of the sheet-gripping member 2. The projections 7 are positioned on the surface 3 in first and second rows which extend skew to one another so as to form an oblique raster. The raster is formed by the lines extending through the centers of the projections which lines are inclined with respect to the direction of traveling of the sheet 6. One set of rows of the projections 7 in the raster is extended at first angle $\beta$ of 74° with respect to the longitudinal side of the sheet-supporting surface 3, whereas the second set of rows of the projections 7 in the raster extends at the second angle $\gamma$ of 52° relatively to the same side of the surface 3. As may be clearly seen in FIG. 3, the projections 7 are spaced from one another in two mutually normal directions. The projections 7 located in rows extending in the direction of sheet travel are spaced from one another a first predetermined distance which is shown by lines 11. The projections located in rows extending in the direction transversal to the sheet travel are spaced from one another a second predetermined distance shown by lines 11'. The magnitude of the angles $\beta$ and $\gamma$ defines these predetermined distances so that the distances shown by the lines 11 are substantially smaller than the distances between two neighboring rows shown by lines 11'.

In such structure of the sheet-supporting surface, less than 100 projections 7 are positioned per one square centimeter of the area of the surface 3, which results in the fact that the total surface area of the projections forms less than 10% of the entire area of the sheet-supporting surface 3.

The projections 7 may also be shaped as a truncated pyramid with an angle of inclination equal at most 45°. In this embodiment, the surface edges of the projections also have rounded portions 9.

In the sheet-gripping device of the invention, the reliable gripping and transferring sheet process without possible distortion of the sheets being processed is warranted since the optimal iniform standard distribution of stressing loads exerted on the contacting surfaces of the gripping members is obtained. The surface load per each supporting point is reduced in the proposed gripping surface structure to a minimum and the stable local stress distribution per each supporting point is provided by means of rounded surface portions 9.

By provision of relatively slim angle of inclination of frusto-conical or pyramidal projections 7 a sufficiently uniform effect is originated in cooperation between the projections 7 with the elastic counter sheet-supporting surface 4 despite the relatively high hardness thereof, whereby the gripping or arresting affect is considerably increased when the usual standard forces are exerted so that the possible slippage of the sheet-gripping member 2 is totally avoided.

By provision of the sheet-gripping member 2 with the surface 3 constructed as described above and forming the counter sheet-supporting surface 5 of elastic material the replacement of the counter sheet-supporting member 4 becomes easier. The utilization of the counter sheet-gripping member 4 having the supporting surface 5 made of elastic material with the hardness at most 70 degrees on the Shore scale provides the sufficiently increased uniform effect and thus relatively high arresting effect under the same standard loads.

This possibility may be successfully used in the grippers closed in a vertical direction such as sheet-gripping member 2 disclosed herein because in the usual oscillating sheet-gripping elements, slippage and resulting damage and deviation from a predetermined position of sheets being processed may easily occur which is totally indesirable.

It will be understood that each of the elements described above, or two or more together, may also find a useful application in other types of a sheet-gripping arrangement differing from the types described above.

While the invention has been illustrated and described as embodied in a sheet-gripping arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sheet gripping arrangement for sheet-processing machines, comprising a sheet-gripping member having an outer sheet-supporting surface contacting a sheet being processed and a counter sheet-gripping member having a counter sheet-supporting surface, said sheet-gripping member and said counter sheet-gripping member holding a sheet being processed in a predetermined traveling direction, said outer sheet-supporting surface including a plurality of projections positioned in a first and a second rows, at least one of said rows being inclined to said predetermined traveling direction, said first and second rows extending skew to one another so as to form an oblique raster, each of said projections having the shape of a slim truncated cone.

2. A sheet gripping arrangement for sheet-processing machines, comprising a sheet-gripping member having an outer sheet-supporting surface contacting a sheet being processed and a counter sheet-gripping member having a counter sheet-supporting surface, said sheet-gripping member and said counter sheet-gripping member holding a sheet being processed in a predetermined traveling direction, said outer sheet-supporting surface including a plurality of projections positioned in a first and a second rows, at least one of said rows being inclined to said predetermined traveling direction, said first and second rows extending skew to one another so as to form an oblique raster, each of said projections having the shape of a truncated pyramid.

3. The arrangement of claim 1 or 2, wherein said outer sheet-supporting surface is made of non-elastic material and said counter sheet-supporting surface is made of elastic material.

4. The arrangement of claim 3, wherein said projections in said raster are spaced from one another in a direction of sheet travelling a first predetermined distance and in a direction transversal to the sheet traveling a second predetermined distance, said first predetermined distance being substantially smaller than said second predetermined distance.

5. The arrangement of claim 4, wherein less than 100 said projections are positioned per 1 square centimeter on said sheet-supporting surface and the total surface of said projections forms less than 10% of the entire area of said outer sheet-supporting surface.

6. The arrangement of claim 5, wherein the size of each of said projections at the outer end thereof is 0,3 mm.

7. The arrangement of claim 6, wherein said projections have surface edges which are rounded.

8. The arrangement of claim 7, wherein said elastic material of said counter sheet-support surface has a hardness substantially equal to 90° on the Shore scale.

9. The arrangement of claim 8, wherein said sheet-gripping member is adapted to move in a vertical direction.

10. The arrangement of claim 1, wherein the angle of the cone of said projections is at most 45°.

11. The arrangement of claim 2, wherein the angle of inclination of said pyramid is at most 45°.

* * * * *